US006015337A

United States Patent [19]

Hiyama et al.

[11] Patent Number: 6,015,337

[45] Date of Patent: Jan. 18, 2000

[54] POLISHING APPARATUS

[75] Inventors: Hirokuni Hiyama, Tokyo; Yutaka Wada, Kanagawa-ken, both of Japan

[73] Assignee: Ebara Corporation, Tokyo, Japan

[21] Appl. No.: 08/891,993

[22] Filed: Jul. 14, 1997

Related U.S. Application Data

[63] Continuation of application No. 08/683,421, Jul. 18, 1996, abandoned.

[30] Foreign Application Priority Data

Jul. 20, 1995 [JP] Japan ..... 7-206591

[51] Int. Cl.[7] ..... B24B 5/00; B24B 29/00

[52] U.S. Cl. ..... 451/288; 451/287; 451/41

[58] Field of Search ..... 451/57, 58, 59, 451/287, 313, 548, 285, 288, 289, 550, 913, 41, 42

[56] References Cited

U.S. PATENT DOCUMENTS

| | | | |
|---|---|---|---|
| 2,826,015 | 3/1958 | Osenberg | 451/548 |
| 2,867,063 | 1/1959 | Metzger | 451/548 |
| 3,891,409 | 6/1975 | Keith, Jr. | 451/313 |
| 5,007,207 | 4/1991 | Phaal | 451/548 |
| 5,377,451 | 1/1995 | Leoni et al. | 451/287 |
| 5,503,592 | 4/1996 | Neumann | 451/41 |

FOREIGN PATENT DOCUMENTS

| | | |
|---|---|---|
| 6-8133 | 1/1984 | Japan . |
| 6-333891 | 12/1994 | Japan . |

*Primary Examiner*—David A. Scherbel
*Assistant Examiner*—Derris Holt Banks
*Attorney, Agent, or Firm*—Wenderoth, Lind & Ponack, LLP

[57] ABSTRACT

A polishing apparatus for polishing for example a semiconductor wafer to a high degree of flatness includes a turntable to the upper surface of which is affixed a polishing cloth and a top ring. A surface of the workpiece interposed between the polishing cloth on the turntable and the top ring is polished by pressing the workpiece against the polishing cloth with a predetermined pressure and moving the turntable and the top ring relative to each other. The turntable includes a set of annular small tables each of which is smaller than the diameter of the workpiece and determined on the basis of an area of effect on the workpiece.

11 Claims, 5 Drawing Sheets

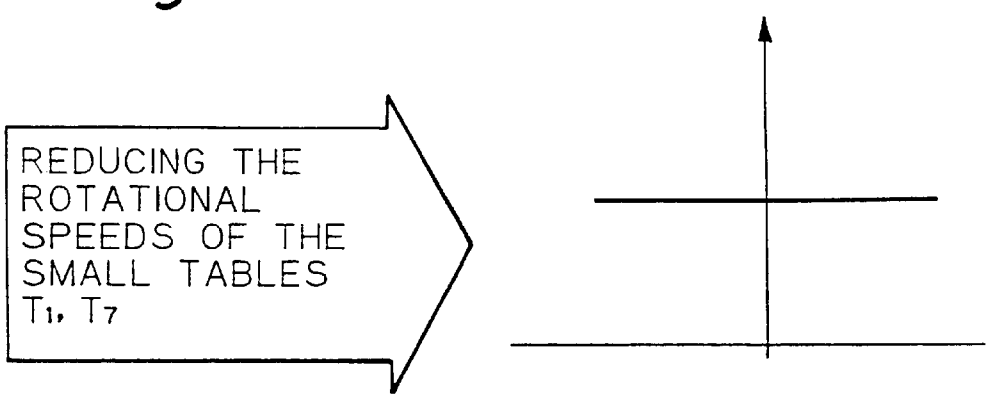
Fig. 4(a)
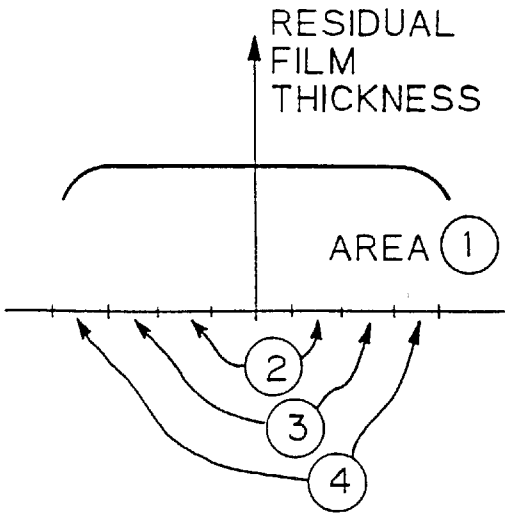
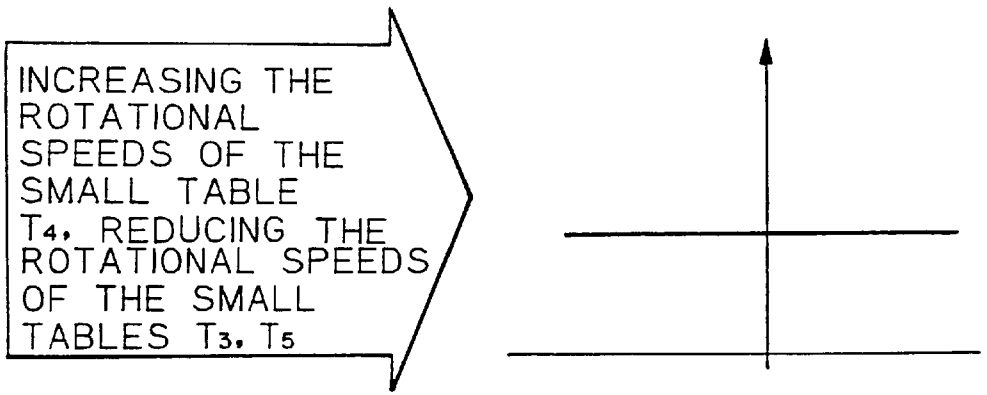
Fig. 4(b)
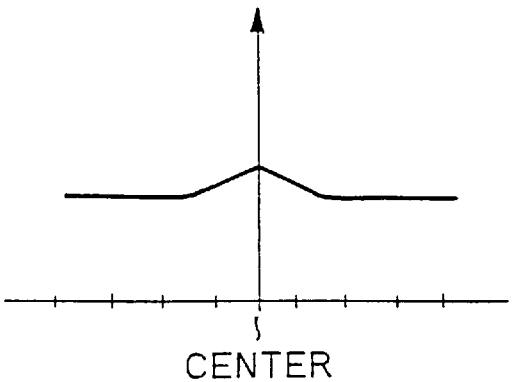

POLISHING APPARATUS

This application is a continuation of now abandoned application, Ser. No. 08/683,421, filed Jul. 18, 1996.

BACKGROUND OF THE INVENTION

This invention relates to a polishing apparatus, and particularly to a polishing apparatus for polishing a workpiece such as a semiconductor wafer to a flat and mirror-like finish.

In recent years, along with progress in the realization of highly integrated semiconductor devices, circuit wiring has been becoming finer and distances between wires have also been becoming smaller. In particular, in the case of sub −0.5 μm photolithography, because the depth of focus is shallow, flatness of stepper focusing surfaces is required.

For this reason it is necessary to flatten the surface of the semiconductor wafer, and as one method of carrying out this flattening, polishing with a polishing apparatus has been being carried out. In this kind of polishing apparatus, a turntable and a top ring each of which rotate at an independent speed are disposed facing each other, the top ring applies a fixed pressure to the turntable and polishing is carried out with the workpiece held between the top ring and a polishing cloth on the turntable containing an abrasive liquid.

The polishing apparatus described above is required to perform polishing such that the workpiece after polishing has a high degree of flatness. For this reason, polishing apparatuses wherein the holding surface holding the semiconductor wafer during polishing, i.e. the lower end surface of the top ring, and the contact surface of the polishing cloth making contact with the semiconductor wafer, and therefore the surface of the turntable to which the polishing cloth is affixed, have a highly accurate flatness have been considered preferable and have been used.

On the other hand, as factors influencing the polishing effect of a polishing apparatus, it is known that not only the shapes of the top ring holding surface and the polishing cloth contact surface but also the relative velocity of the polishing cloth and the semiconductor wafer, the distribution of the pushing pressure on the polishing surface of the semiconductor wafer, the amount of abrasive liquid on the polishing cloth and the time for which the polishing cloth has been used have an influence. Therefore, it can be supposed that if these factors were to be made equal over the entire polishing surface of the semiconductor wafer, a highly accurate flatness could be obtained.

However, among these factors influencing the polishing effect there are factors which can be made equal over the entire polishing surface and factors for which this is extremely difficult. For example, whereas the relative velocity of the polishing cloth and the semiconductor wafer can be made uniform by making the turntable and the top ring rotate at the same speed and in the same direction, it is difficult to make the amount of abrasive liquid uniform because of the effect of centrifugal force.

Therefore, with an approach which relies on making the factors influencing the polishing effect equal over the entire polishing surface, including making the upper surface of the polishing cloth on the turntable facing the lower end surface of the top ring flat, there is a limit to the flatness of the polished surface after polishing and there are cases wherein it is not possible to obtain the required flatness.

In this connection, a method for obtaining a highly accurate flatness, as shown in JP-A-6-333891 (Japanese Unexamined Patent Publication No. H.6-333891), includes making the holding surface of the top ring a concave or convex surface and distributing the pushing pressure over the polishing surface of the semiconductor wafer, thereby correcting nonuniformity of the polishing effect caused by dispersion in penetration of the abrasive liquid and the time for which the polishing cloth has been used.

Also, measures such as providing the top ring with a diaphragm structure and correcting nonuniformity of the polishing effect by changing the pressure distribution during polishing have been employed.

However, when the shape of the holding surface of the top ring is altered, because the holding surface of the top ring is always in contact with the semiconductor wafer it continuously has an affect on polishing throughout the polishing process. That is, there has been the problem that because the shape of the holding surface of the top ring tends to influence the polishing effect too much, it is extremely difficult to correct nonuniformity of the polishing effect by intentionally providing the holding surface of the top ring with a non-flat shape, and when the intended shape of the holding surface of the top ring is even slightly unsuitable, flatness of the polished surface of the wafer actually is lost or correction is insufficient and adequate flatness of the polished wafer surface is not obtained.

Also, when correction is carried out by altering the shape of the top ring holding surface, because the top ring holding surface is of substantially the same size as the polished wafer surface it has been necessary to perform complex shape correction in an excessively small area. This also has made carrying out correction of the polishing effect by altering the shape of the holding surface of the top ring problematic.

Furthermore, in conventional polishing apparatuses, and particularly in polishing apparatuses for polishing semiconductor wafers and the like, it is intended that the polished surface of the workpiece after polishing be flat. With respect to intentionally polishing to a non-flat shape or polishing so as to increase or decrease the amount of polishing of targeted areas of the polished surface, there have been almost no suitable means or apparatuses other than that described above.

SUMMARY OF THE INVENTION

The present invention was devised to solve the above-mentioned problems, and an object of the invention is to provide a polishing apparatus with which it is possible to easily correct nonuniformity of polishing and also a polishing apparatus with which it is possible to polish specified areas of a surface to be polished preferentially.

To achieve the above-mentioned object and other objects, the invention provides a polishing apparatus which has a turntable to the upper surface of which a polishing cloth is affixed and a top ring. A surface of a workpiece interposed between the polishing cloth on the turntable and the top ring is polished by pressing the workpiece against the polishing cloth with a predetermined pressure and moving the turntable and the top ring relative to each other. The turntable comprises a set of a plurality of coaxially disposed annular small platens or tables and the radial direction width of each of the small tables is smaller than the diameter of the workpiece is determined on the basis of an area of effect on the workpiece.

According to the invention, because the parts or areas of the workpiece polished by the respective small tables are different, if the rotational speeds of the small tables divided in concentric ring form are individually controlled, it is possible to polish different parts of the same workpiece at different polishing rates. That is, because the mechanical polishing rate is proportional to the product of the surface pressure at which the workpiece is pressed against the table and the relative velocity of the workpiece and the table ($V=\eta pv$, V: polishing rate, $\eta$: constant of proportionality, p: surface pressure, v: relative velocity), if the rotational speed of the table is changed it is possible to change the amount of polishing carried out.

In this invention, because it is possible to independently control the speeds of the annular small tables individually, it is possible-to freely set their influences on the workpiece without speed restrictions and control of the amount of polishing of the workpiece can be changed freely. As a result, polishing the entire surface of the workpiece uniformly according to various conditions and polishing specified parts of the workpiece preferentially are also possible.

With conventional methods involving forming concavities or convexities in the table, when the rotation of the workpiece and the rotation of a convex part or a concave part are in synchronization, one part of the workpiece only is strongly affected and consequently when attempting to achieve a uniform effect in the circumferential direction there have inevitably been restrictions on selection of the speeds of the table and the workpiece. However, with this invention there are no such restrictions on speeds.

Also, when a concave part or a convex part is formed, because the surface pressure of the workpiece on parts other than the concave part or convex part changes, the amount of polishing of parts where the concave part or convex part do not act also changes and it is complicated to accurately predict the overall effect in advance. However, with this invention the surface pressure also does not change and therefore prediction of results is simple and it is possible to control the amount of polishing of the workpiece freely.

BRIEF DESCRIPTION OF THE DRAWINGS

FIGS. 4(*a*) and 4(*b*) are graphs illustrating the operation and an effect of the polishing apparatus, FIG. 4(*a*) showing a case where the film thickness of only a peripheral portion is smaller than that of others, and FIG. 4(*b*) showing a case where the film thickness of only a center portion remains thick.

DETAILED DESCRIPTION OF THE PREFERRED EMBODIMENTS

A preferred embodiment of a polishing apparatus according to the invention will now be described with reference to the accompanying drawings. In this preferred embodiment, a semiconductor wafer is used as an example of a workpiece.

Figure 1:
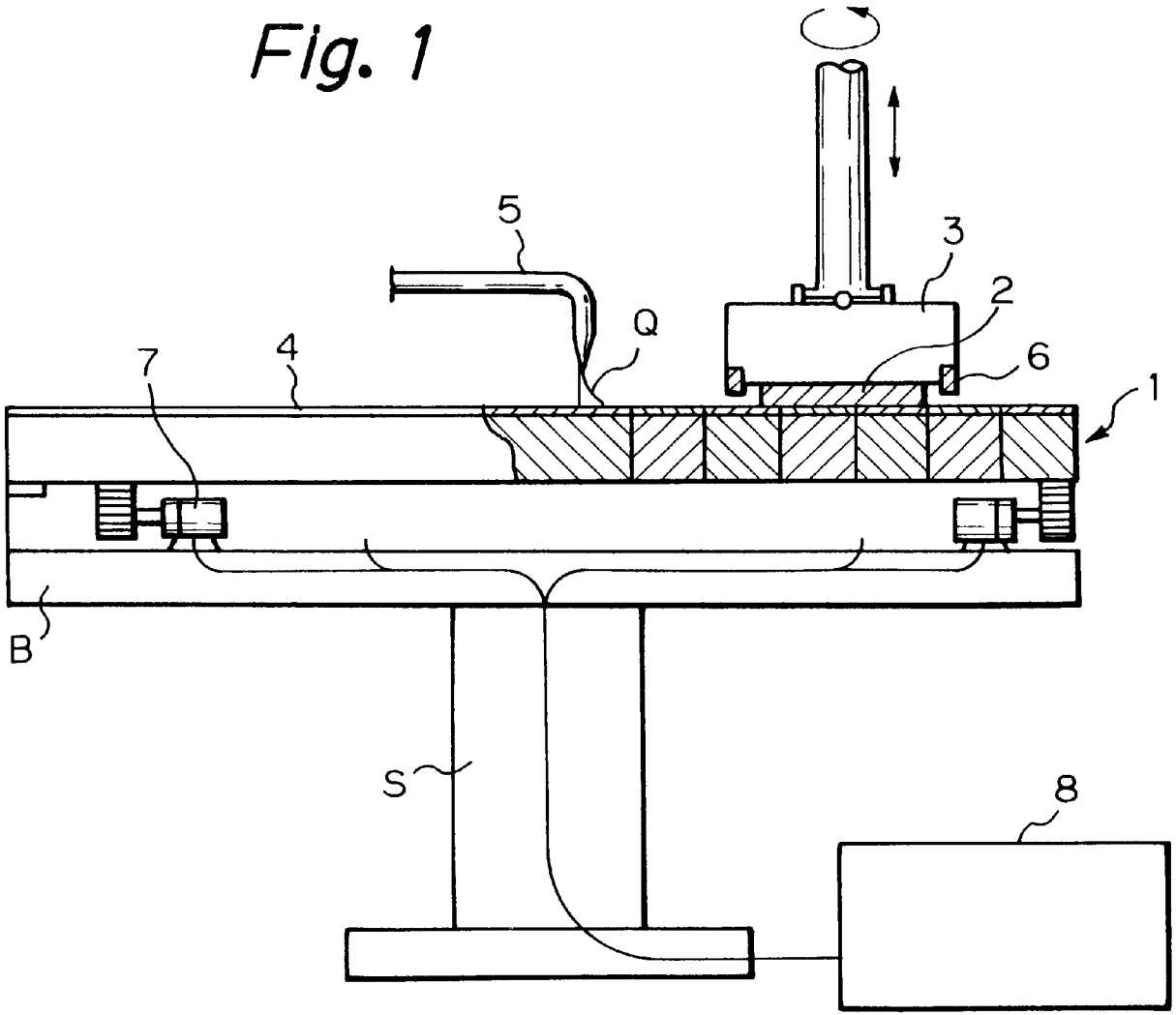
FIG. 1 is a partially sectional view showing the overall construction of a polishing apparatus of a preferred embodiment of the invention.
Figure 2A:
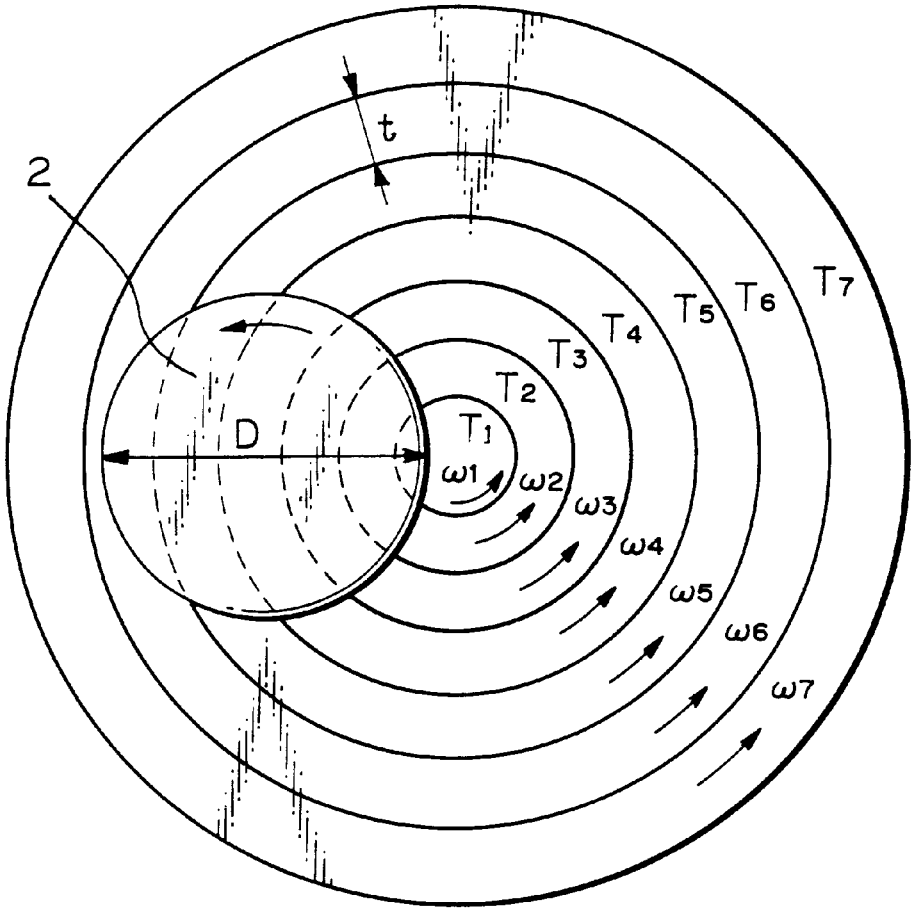
FIGS. 2(*a*)–2(*d*) illustrate the construction of a turntable of such polishing apparatus, FIG. 2(*a*) being a plan view, FIG. 2(*b*) being a sectional view, FIG. 2(*c*) exemplifying the turntable divided into three small pletens or tables, and FIG. 2(*d*) exemplifying the turntable divided into five small platens or tables.
Figure 2B:
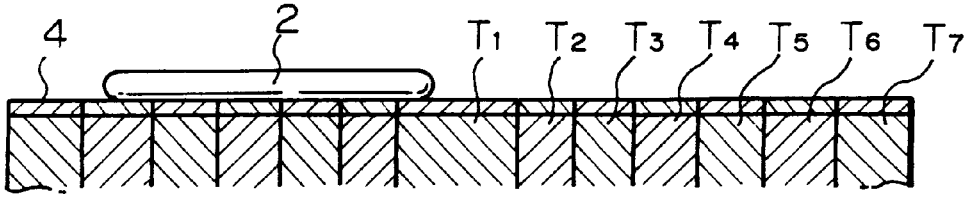
Figure 2C:
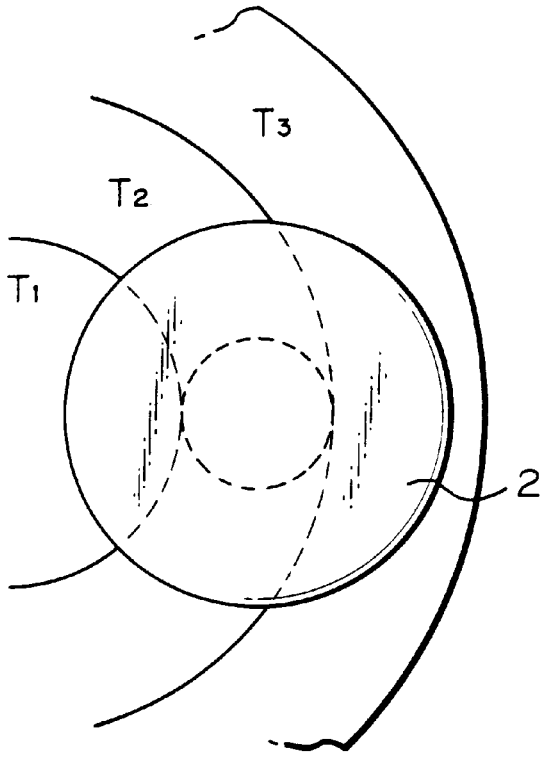
Figure 2D:
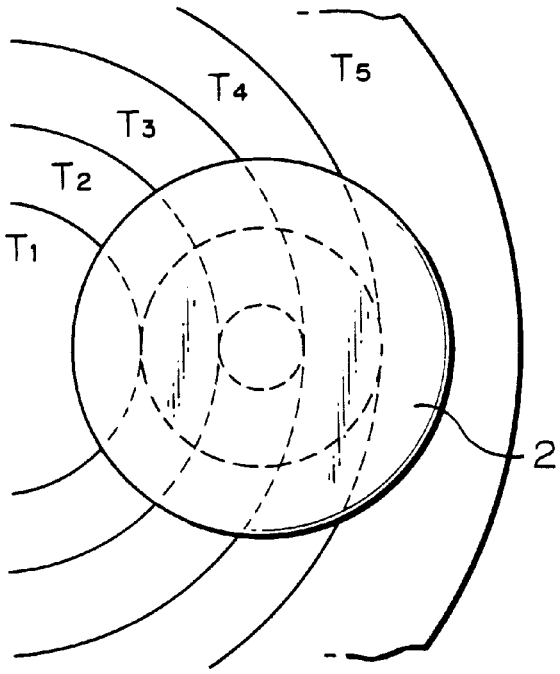

FIG. 1 is a vertical sectional view showing the overall construction of a polishing apparatus according to the invention. This polishing apparatus comprises a base B disposed on a top surface of a stand S, a turntable 1 rotatably disposed on the base B and a top ring 3 for holding a semiconductor wafer 2 and pressing it against the turntable 1. A polishing cloth 4 is affixed to the upper surface of the turntable 1 and forms a polishing surface thereof.

The top ring 3 is connected to a motor (not shown) and is also connected to a raising and lowering cylinder (not shown). As a result, the top ring 3 is vertically movable as shown by the arrow and is also rotatable about its axis, and can press the semiconductor wafer 2 against the polishing cloth 4 with a freely determined pressure. An abrasive liquid nozzle 5 is disposed above the turntable 1, and abrasive liquid Q is supplied by the abrasive liquid nozzle 5 to the polishing cloth 4 affixed to the turntable 1. A guide ring 6 for preventing the semiconductor wafer 2 from slipping off the top ring 3 is provided around the periphery of the lower end of the top ring 3.

FIGS. 2(*a*)–2(*d*) show a turntable and polishing cloth of this preferred embodiment in detail, FIG. 2(*a*) being a plan view and FIG. 2(*b*) being a sectional view. As shown in FIG. 2(*a*), the turntable 1 is divided into a central disc-shaped small platen or table $T_1$ and annular small platens or tables $T_2$, $T_3$, $T_4$, $T_5$, $T_6$ and $T_7$ surrounding small table $T_1$ coaxially. To each of such small tables is affixed an annular polishing cloth 4 of the same disc shape or annular shape as the respective small table. The width t of each of the annular small tables $T_2$ to $T_7$ is smaller than the diameter D of the semiconductor wafer 2, and the semiconductor wafer 2 is polished by the plurality of small tables $T_1$ to $T_7$ as shown in FIG. 2(*a*). The greater is the number of these tables, the greater is the degree of freedom with which the distribution of the amount of polishing of the semiconductor wafer 2 can be controlled.

For example, when wanting to control the amounts of polishing of a central area and a peripheral area of the semiconductor wafer 2, such this control is possible if the turntable is divided into at least three small tables $T_1$ to $T_3$ as shown in FIG. 2(*c*). When the amount of polishing of an intermediate area of the wafer is to be controlled, such control is possible if the turntable is divided into five small tables $T_1$ to $T_5$ as shown in FIG. 2(*d*). That is, to control the amount of polishing of smaller and more numerous areas of the semiconductor wafer 2, it is only necessary to increase the number of small tables. From the point of view of productivity, diameters semiconductor wafers 2 have been increasing and are expected to increase in the near future from the current 6-inch and 8-inch diameter wafers to sizes exceeding 12 inches. Because the achievement of flatness is even more difficult in the polishing of this kind of large-diameter wafer, technology for selective control of amounts of polishing such as that of this invention becomes important. If the number of small tables is increased along with increases in the diameter of the wafer, the degree of freedom of control of the amount of polishing also increases, and this is advantageous.

The small tables $T_1$ to $T_7$ are each made rotatable on the base B by a guide mechanism not shown in the drawings, and a drive device (a motor with a gearbox) 7 is provided on the base B for each of the small tables $T_1$ to $T_7$, as shown in FIG. 1. These drive devices 7 are connected to a speed control device 8, and the speed of each of the small tables $T_1$ to $T_7$ can be controlled individually.

In a polishing apparatus of the above construction, the semiconductor wafer 2 is held on the bottom surface of the top ring 3 and the semiconductor wafer 2 is pressed against the polishing cloth 4 on the upper surface of the rotating turntable 1 by the raising and lowering cylinder. Abrasive liquid Q is fed through the abrasive liquid nozzle and held by the polishing cloth 4, and polishing is carried out with abrasive liquid Q existing between the surface of the semiconductor wafer 2 which is being polished (the lower surface) and the polishing cloth 4.

Figure 3:
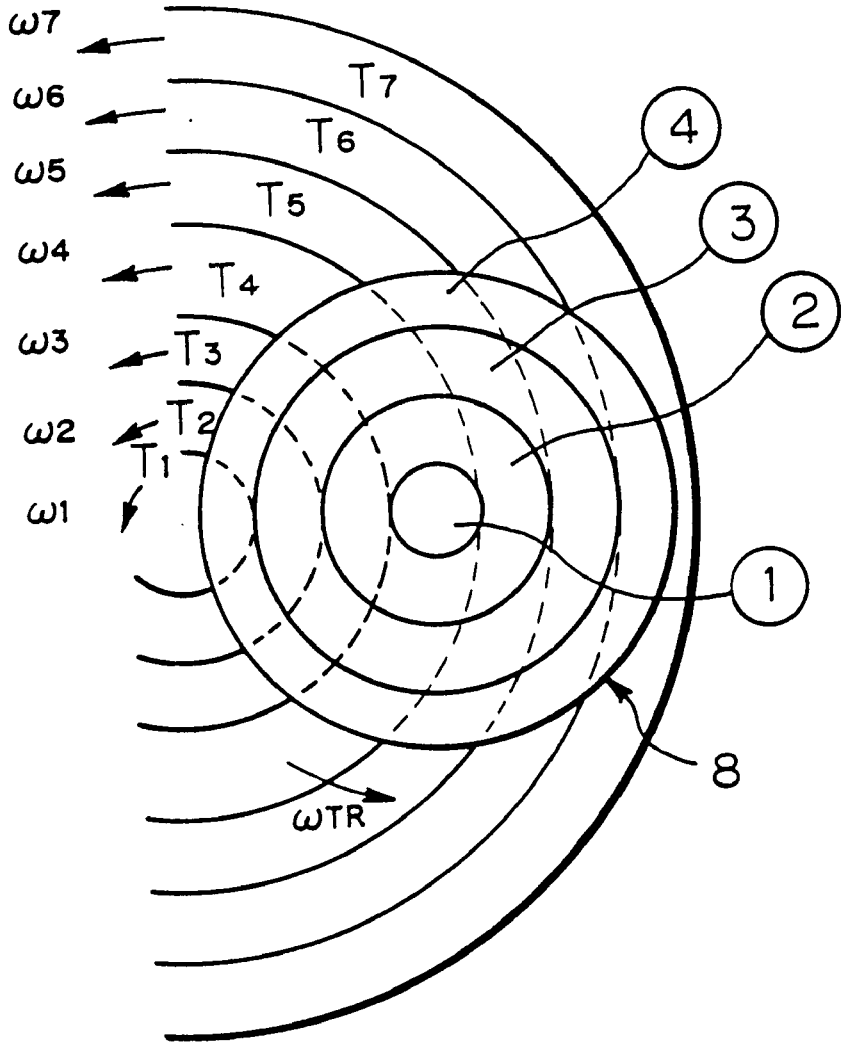
FIG. 3 is a schematic view illustrating the operation of the polishing apparatus.

Next, a method of freely controlling the amount of polishing of the semiconductor wafer 2 area by area thereof will be described with reference to FIG. 3. As shown in FIG. 3, it will be supposed that the turntable 1 comprises concentric small tables $T_1$ to $T_7$ and that these respectively rotate at rotational speeds $\omega_1$ to $\omega_7$. The speed of rotation of the semiconductor wafer 2 being polished will be $\omega_{TR}$, and as shown in FIG. 3 the surface of the semiconductor wafer 2 will be divided into a central disc-shaped area ① and annular areas ② to ④ surrounding area ①. The diameter of the area ① and the widths of the areas ② to ④ are set to be equal to the width t of the small tables.

The different areas of the wafer 2 are polished by the small tables as follows:

| Wafer Area | Small Tables Polishing the Area | | | | | | |
|---|---|---|---|---|---|---|---|
| ① | | | | $T_4$ | | | |
| ② | | $T_3$, | $T_4$, | $T_5$ | | | |
| ③ | | $T_2$, | $T_3$, | $T_4$, | $T_5$, | $T_6$ | |
| ④ | $T_1$, | $T_2$, | $T_3$, | $T_4$, | $T_5$, | $T_6$, | $T_7$ |

That is, the number of small tables polishing the semiconductor wafer 2 varies from area to area. For example, because the small table $T_1$ and the small table $T_7$ only polish the area ④ when as shown in FIG. 4(*a*) the film thickness of area ④ only is smaller than that of the other areas, if the speeds of the small tables $T_1$ and $T_7$ are reduced, the amount of polishing of just the area ④ of the wafer 2 can be changed and the film thickness thereby made uniform.

However, the other small tables $T_2$ to $T_6$ contributing to the polishing of areas other than the area ④ are all involved in some measure in the polishing of more than one area. Therefore, when wanting to control the amount of polishing of just one of the areas ① to ③ it is necessary to change the speeds of a plurality of small tables. As shown in FIG. 4(*b*), when the film thickness of only the area ① remains thick, the amount of polishing of just this area must be increased. To do this, it is only necessary to increase the speed of the small table $T_4$, but because the small table $T_4$ also contributes to the polishing of the other areas ① to ③, simply increasing the speed of the small table $T_4$ will also increase the amount of polishing of areas other than the area ④. To overcome this, it is only necessary to reduce the speeds of the small tables $T_3$ and $T_5$, etc. to cancel out the polishing rate increase accompanying the speed increase of the small table $T_4$. Reversely, when wanting to reduce the amount of polishing of only the area ①, it is only necessary to reduce the speed of the small table $T_4$ and raise the speeds of the small tables $T_3$ and $T_5$, etc. in the reverse of that which is described above.

Also, when controlling the amounts of polishing of the area ② or the area ③, because the small table T4 contributes to the polishing of all the areas, it is possible to carry out this control by the same method as described above using small tables other than the small table $T_4$. Therefore, by dividing the turntable into annular small tables and adjusting the speed of each according to this invention, it is possible to freely control the distribution of the amount of polishing of the workpiece.

With this invention, because a turntable comprises a set of a plurality of coaxially disposed annular small tables and the radial direction width of each of the small tables is smaller than the diameter of the workpiece and is determined on the basis of an area of effect on the workpiece, it is possible to freely control the amount of polishing of the workpiece area by area. Also, because this kind of effect is obtained without there being any restrictions on turntable speed and the surface pressure does not change as it does in cases where concavities and convexities are formed, prediction of the polishing effect is also simple and freely controlling the amount of polishing of the workpiece is easy.

What is claimed is:

1. A polishing apparatus including a turntable with an upper polishing surface, and a top ring for pressing a surface of a workpiece to be polished against said polishing surface with a predetermined pressure while moving said turntable and said top ring relative to each other, said turntable comprising:

at least three coaxially disposed small platens including a central disc-shaped small platen and at least two annular small platens coaxially surrounding said disc-shaped small platen; and each said small platen having a width in a radial direction thereof that is smaller than a diameter of the surface of the workpiece to be polished and is of a dimension such that during a polishing operation the surface of the workpiece to be polished is polished by at least three of said small platens.

2. A polishing apparatus as claimed in claim 1, wherein said top ring has a lower surface contacting the workpiece to be polished during a polishing operation, and said width dimension of each said small platen is smaller than a diameter of said lower surface of said top ring.

3. A polishing apparatus as claimed in claim 1, wherein said turntable comprises at least five said coaxially disposed small platens.

4. A polishing apparatus as claimed in claim 1, wherein each of said small platens is separately and independently rotatable.

5. A polishing apparatus as claimed in claim 1, further comprising a drive control which controls independently rotation of each of said small platens.

6. A polishing apparatus as claimed in claim 1, wherein said top ring is operable to rotate the workpiece at a given speed around an axis perpendicular to said upper polishing surface of said turntable.

7. A polishing apparatus as claimed in claim 1, wherein said upper polishing surface of said turntable comprises separate polishing cloth portions affixed to respective said small platens.

8. A turntable to be employed in a polishing apparatus, said turntable having an upper polishing surface against which a surface of a workpiece to be polished is pressed with a predetermined pressure by a top ring of the polishing apparatus while the top ring and said turntable are moved relative to each other, said turntable comprising:

at least three coaxially disposed small platens including a central disc-shaped small platen and at least two annular small platens coaxially surrounding said disc-shaped small platen; and each said small platen having a width in a radial direction thereof that is smaller than a diameter of the surface of the workpiece to be polished and is of a dimension such that during a polishing operation the surface of the workpiece to be polished is polished by at least three of said small platens.

9. A turntable as claimed in claim 8, comprising at least five said coaxially disposed small platens.

10. A turntable as claimed in claim 8, wherein each of said small platens is separately and independently rotatable.

11. A turntable as claimed in claim 8, wherein said upper polishing surface of said turntable comprises separate polishing cloth portions affixed to respective said small platens.

* * * * *